US006511727B1

(12) United States Patent
Bleibler et al.

(10) Patent No.: US 6,511,727 B1
(45) Date of Patent: Jan. 28, 2003

(54) FLAT STRIP LAMELLA FOR REINFORCING BUILDING COMPONENTS AND METHOD FOR THEIR PRODUCTION

(75) Inventors: Alexander Bleibler, Winterthur (CH); Ernesto Schümperli, Wollerau (CH); Werner Steiner, Winterthur (CH)

(73) Assignee: Sika AG, vormals Kaspar Winkler & Co. (CH)

( * ) Notice: Subject to any disclaimer, the term of this patent is extended or adjusted under 35 U.S.C. 154(b) by 0 days.

(21) Appl. No.: 09/341,771

(22) PCT Filed: Jan. 20, 1998

(86) PCT No.: PCT/EP98/00270

§ 371 (c)(1),
(2), (4) Date: Jul. 16, 1999

(87) PCT Pub. No.: WO98/32933

PCT Pub. Date: Jul. 30, 1998

(30) Foreign Application Priority Data

Jan. 23, 1997 (DE) ..... 197 02 249
Jul. 31, 1997 (DE) ..... 197 33 065

(51) Int. Cl.[7] ..... B32B 1/08

(52) U.S. Cl. ..... 428/50; 628/81; 628/192; 628/298.1; 264/285; 264/640; 264/645; 264/671

(58) Field of Search ..... 428/80, 81, 192, 428/298.1; 264/285, 640, 645, 671

(56) References Cited

U.S. PATENT DOCUMENTS 5,085,928 A * 2/1992 Krueger ..... 428/113

* cited by examiner

*Primary Examiner*—Elizabeth M. Cole
(74) *Attorney, Agent, or Firm*—Pendorf & Cutliff

(57) ABSTRACT

Flat strip lamella for reinforcing weight-carrying or weight-transferring building components. It has a composite structure consisting of a plurality of pliant or loose-flex supporting fibers (26) aligned parallel to each other, and a binding matrix (28) which connects the supporting fibers to each other so that they are shear-resistant, and is fastenable by means of an adhesive (16) by its broad side to the surface of the building component (12) that is to be reinforced. So that the flat strip lamella, to which the binding matrix gives rigid elastic form, can also be bent over corner edges of a building component (12), the invention proposes that the binding matrix (28) be removed, in at least an intermediary area (30), by uncovering the supporting fibers (26), and that the uncovered supporting fibers be subjected to a liquid or pasty thermosetting plastic, in order to stabilize the bent-over condition.

10 Claims, 4 Drawing Sheets

Fig. 7a
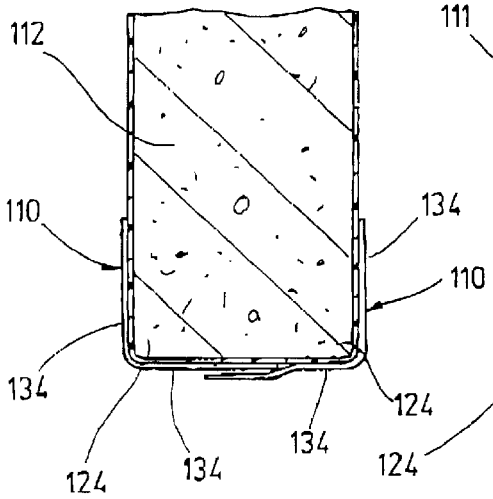
Fig. 7b
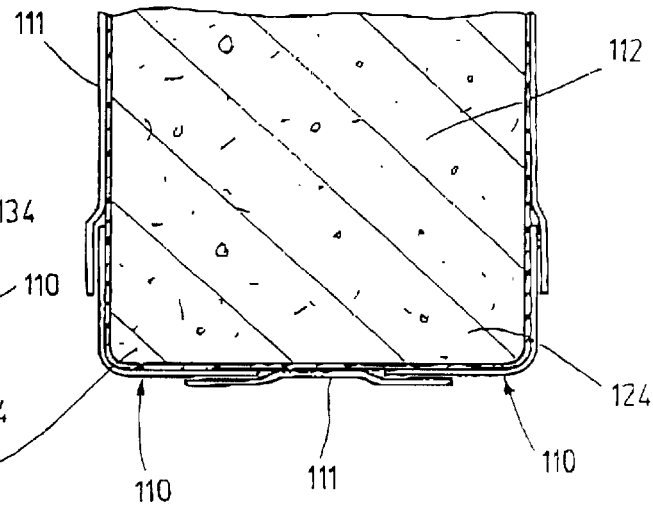
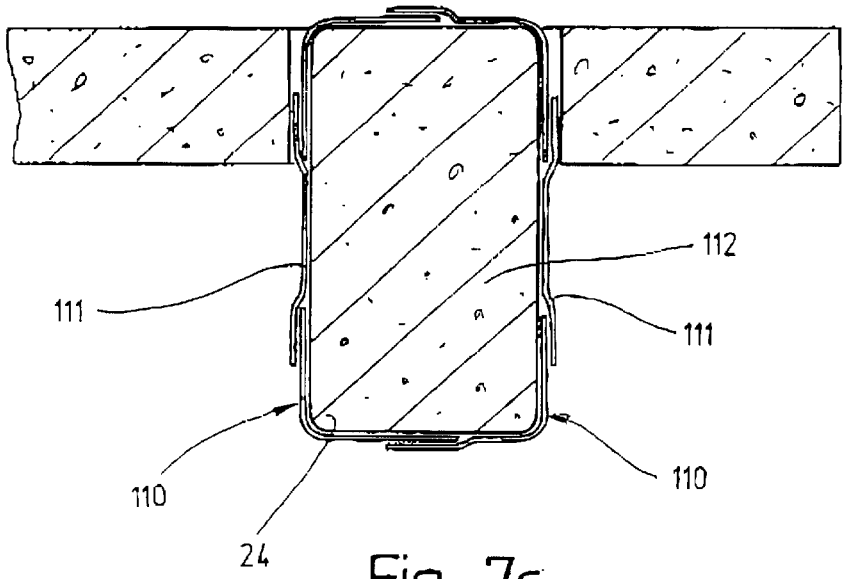
Fig. 7c

FLAT STRIP LAMELLA FOR REINFORCING BUILDING COMPONENTS AND METHOD FOR THEIR PRODUCTION

This application is a 371 of PCT/EP98/00270.

BACKGROUND OF THE INVENTION

1. Field of the Invention

The invention concerns a flat strip lamella for reinforcing load-bearing or weight-transferring building components, having a composite structure consisting of a plurality of pliant or loose-flex supporting fibers and a binder matrix which connects the supporting fibers to each other and which is fastenable by its broad side by means of an adhesive to the surface of the building component. The invention further concerns a process for production of this type of flat strip lamella.

2. Description of the Related Art

Reinforcing lamellas of this type are known for example from WO 96/21785. The reinforcing lamellas are applied to longitudinally extending and/or areal or laminar building components. The binder matrix which is comprised of a stiff elastic Duroplast, for example of epoxy resin, does not make it possible to introduce bends with small bend radius, so that it is not possible to form bow or bracket type reinforcements over an edge or corner of a building component. Bracket or bow-like reinforcements are required for example in the case of concrete reinforced beams or concrete slab T-beams to secure the relationship between the compressive and tensile zones and to avoid shear and transverse fractures.

SUMMARY OF THE INVENTION

Beginning therewith the invention is concerned of a task of developing a flat strip lamella which makes possible a corner overlapping reinforcement of construction components. A further task of the invention is comprised in the development of processes for production of this type of flat strip lamella.

According to a first embodiment of the invention a so-called corner lamella is proposed, which comprises two lamella side pieces which are united with each other into a single piece along an edge running perpendicular to the longitudinal direction of the reinforcing fibers and defining an angle of from 30° to 100° with respect to each other. Since the building components to be reinforced are primary formed as right angles, the sides of the lamella form an angle of 90° to each other. In order dissipate stress forces over the right angles without danger of fracturing, the right angle corner between the lamella side pieces is preferably formed with a radius of curvature of 5 to 50 mm, preferably 15 to 30 mm.

As for the manufacture of this type of angled lamella, there are various possibilities. It has been found to be particularly advantageous when a first longitudinally extending flat strip lamella completely permeated with binder matrix is, at least in an intermediate area, subjected to a bending press at a temperature above the glass transition temperature, preferably at a temperature of 300° C. to 600° C., under formation of two lamella side pieces joined to each other at a corner forming an angle with each other, and subsequently cooled to a lower use temperature under temporary maintenance of the pressure force.

A further inventive variation of the process for manufacture of the angular lamella is comprised therein, that a fiber cord or web comprised of reinforcing fibers is wrapped in a spiral manner about a support body with preferably quadratic or square circumference and is fixed thereto in the wound state, that the wound fiber cord is impregnated with a fluid plastic resin thereby forming a binder matrix, that the plastic resin is hardened to form a composite material tube preferably shaped as a four cornered tube, and that the composite material tube, in certain cases after removal of the support body, is separated crosswise and longitudinally multiple times with formation of the angular lamella with reinforcing fibers extending in the longitudinal direction.

A third inventive variation of the method of manufacture of the angular lamella is comprised therein, that one cord or one web of reinforcing fibers is introduced crosswise into a casting mould with a cavity having a right angled cross section, so that in the cavity fluid binder resin can be injected or poured in for impregnation of the reinforcing fibers, so that the binder material resin is hardened, preferably under the action of pressure and heat, and that subsequently the thereby formed finished angular lamella is removed from the casting mould.

The inventive angle lamellas can be employed for thrust reinforcement, tensile reinforcement or buckle reinforcement of steel reinforced concrete supporting beams, studs or girders, wherein the two side pieces which are at angles to each other are adhered with an adhesive material to two surfaces of a building component forming a corresponding angle with each other. For lengthening of the reinforcing lamella there can be adhered by overlapping with an adhesive layer, on at least one of the lamella side pieces, a second flat strip lamella to be bonded to the appropriate building component surface. Likewise also multiple flat strip lamellas can be overlapped at their free side piece ends and adhered with each other and with the construction component thereby forming a closed lamella ring circumscribing the construction component.

In order that a preformed, longitudinally extending flat strip lamella can be extended over construction component edges, there is proposed in accordance with an alternative embodiment of the invention, to remove the binder matrix in at least one intermediate area, laying bare the reinforcing fibers. The bare reinforcing fibers can be bowed or bent over a preferably rounded-off fixed body or construction component edge and in this condition be impregnated with a fluid or pasty hardenable resin in the area of the exposed reinforcing fibers. The hardened resin stabilizes the previously exposed reinforcing fibers in the condition of being bent over the edge.

The reinforcing fibers are preferably formed of carbon fibers, which are characterized by a high modulus of elasticity. The reinforcing fibers can however contain or be comprised of aramid fibers, glass fibers, polypropylene fibers and the like.

The binder matrix and the synthetic resin subsequently provided upon the exposed reinforcing fibers is preferably of a Duroplast, preferably of epoxy resin, polyurethane resin or polyester resin.

For the production of flat strip lamellas with flexible intermediate areas first an area of lamella completely impregnated with binder matrix is heated at least in the defined intermediate area to a decomposition temperature of the binder and thereby the binder matrix is removed with exposure of the reinforcing fibers. In the case of employment of epoxy resin as the binder the flat strip lamella is heated in the intermediate area to a temperature of between 300° C. and 750° C. Thereafter the flat strip lamella is bent in the intermediate area about a corner of a fixed body or a construction component and before or subsequently impregnated with a hardenable synthetic resin, preferably an epoxy resin.

The inventive flat strip lamellas can be employed for compression reinforcement, tensile reinforcement or buckling reinforcement of steel reinforced concrete beams, studs or girders, wherein the flat strip lamellas are bent in their binder-free intermediate areas about the corners of a construction component and in their bent condition are acted upon by a hardenable resin. In the case that the angle of bending of the edges is too small, the construction components can be provided on their corners with a molding or rounding out piece which increases the radius of the curvature of the corner, prior to application of the flat strip lamella.

BRIEF DESCRIPTION OF THE DRAWINGS

In the following the invention will be described in greater detail by reference to an example shown in schematic form in the drawing. There is shown FIGS. 1*a* and *b* a top view and a side view of the reinforcement lamella with a binder-free, flexible intermediate area;

FIGS. 7*a* through *c* three sectional representations according FIG. 2 for illustration of the application of the corner lamellas according to FIG. 5 in the reinforcement of construction components.

Figure 1A:
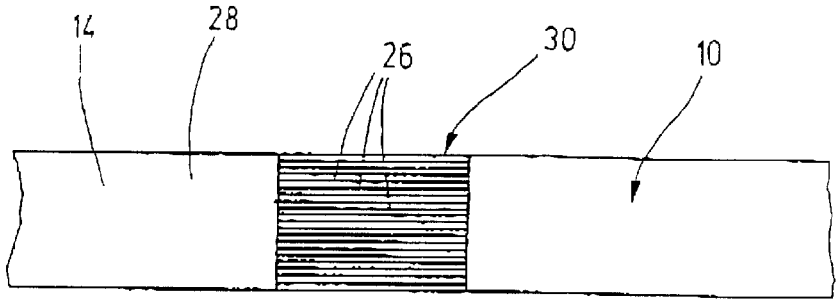
Figure 1B:
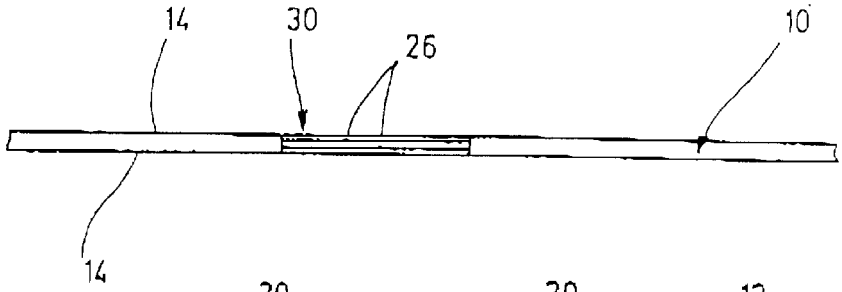

The flat strip lamella 10 shown in FIGS. 1*a* and *b* is designed for post-reinforcement of construction components 12, such as steel reinforced concrete structures and masonry structures. It is secured to the outer surface of the construction component 12 at one of its broad sides 14 with the aid of adhesive 16, preferably an epoxy resin, and additionally anchored at its free ends 18 in recess 20 of the construction component 12 with the aid of adhesive or mortar.

Figure 2:
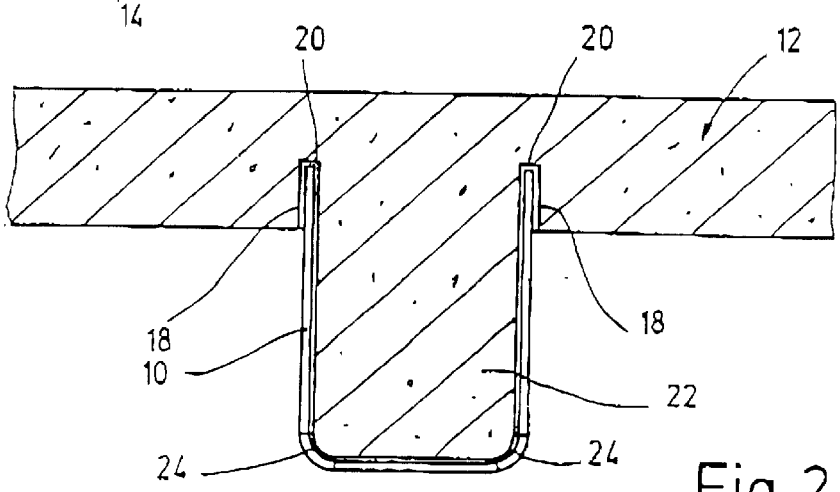
FIG. 2 a section through a steel reinforced concrete slab T-beam with bow-shaped bent reinforcing lamella.
Figure 3:
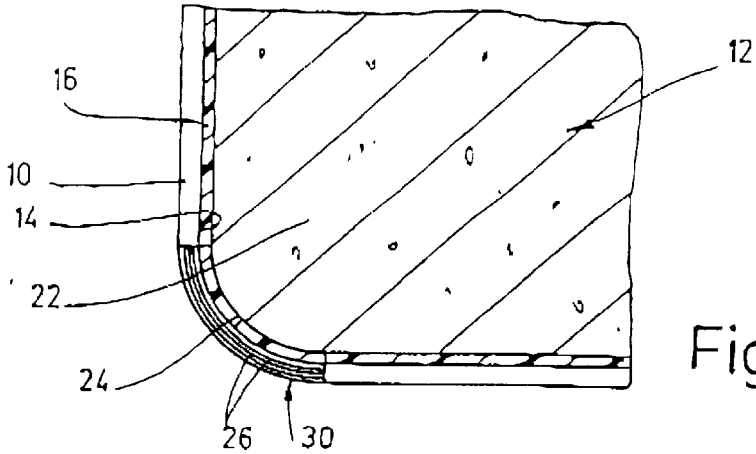
FIG. 3 a section through FIG. 2.

The construction component 12 according to FIGS. 2 and 3 is formed for example of plate girders of steel reinforced concrete, in which the lamella 10 extends in a bow like manner over the cross piece or bridge 22 of the construction component and thereby is bent over the corner edges 24 of the cross piece or bridge 22.

The flat strip lamella is comprised of a composite structure of a plurality of parallel to each other extending flexible or limp reinforcing fibers 26 of carbon fiber and of a binder matrix 28 of epoxy resin which fixes the reinforcing fibers in a shear resistant manner with respect to each other. The binder matrix 28 ensures that the flat strip lamella is relatively stiff and thus basically cannot be bent over the corner edges 24. In order that the lamella 10 however can be bent over the corner edges 24 the binder matrix 28 is removed in an intermediate area 30 under the influence of a temperature of approximately 650° C., so that the flexible or limp reinforcing fibers 26 are exposed. In this manner the flat strip lamella can be bent about 90° in the intermediate area 30 over the rounded-off corner edge 24 and stabilized in the bent condition by impregnation with a hardenable synthetic resin. The reinforcing fibers 26 could also be impregnated with hardenable synthetic resin in the intermediate area 30 prior to assembly, and subsequently, while the resin is still in the soft condition, be bent over the corner edge 24.

Figure 4:
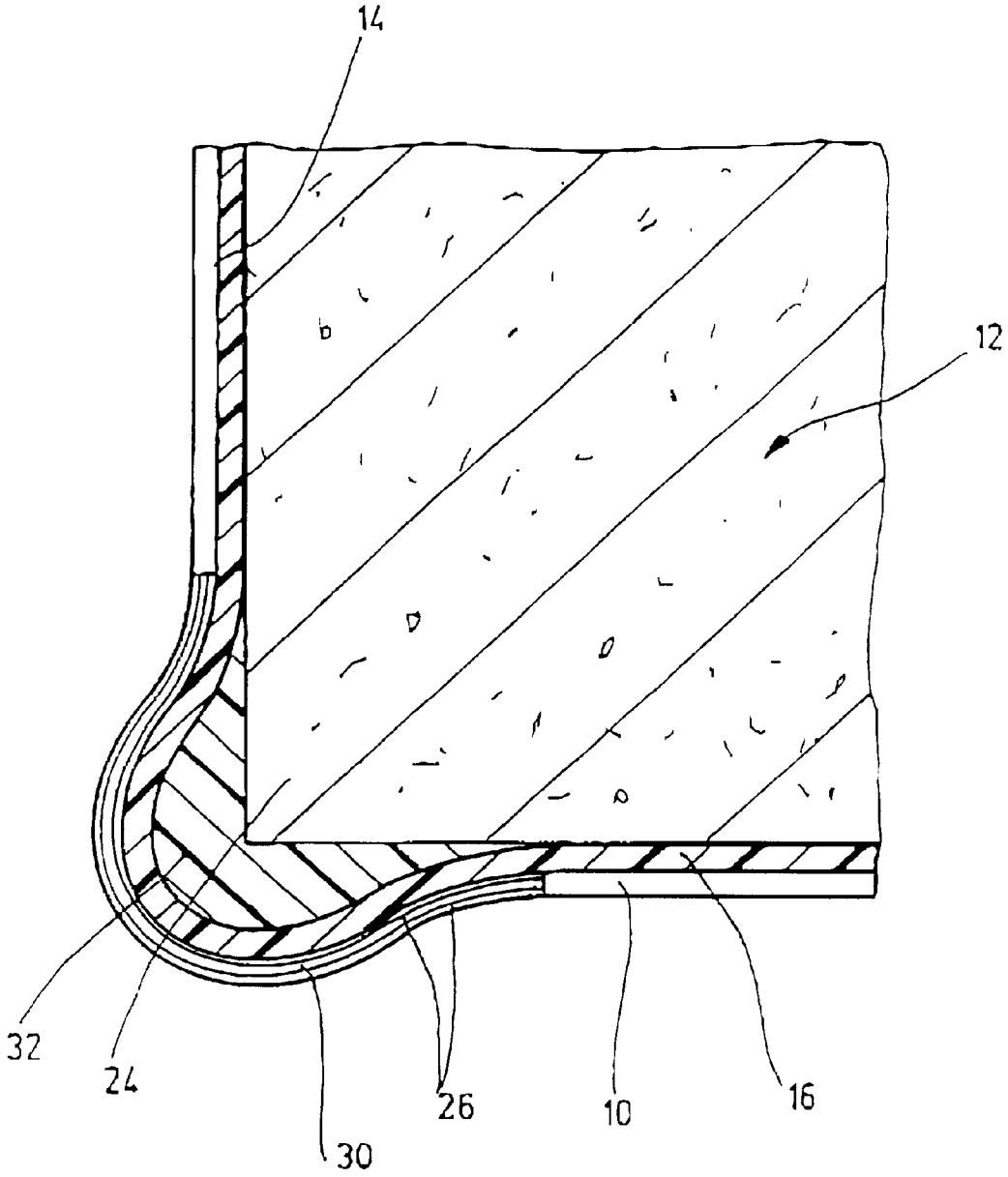
FIG. 4 a section of a construction component with a sharp corner and seated rounding-off part in a sectional representation according to FIG. 3.

In the embodiment shown in FIG. 4 a flit strip lamella 10 is secured to a construction component 12 with sharp edge corners 24. Since the radius of bending of the flat strip lamella cannot exceed a certain minimum value in the intermediate area 30, a rounding of piece 32 preferably of plastic is seated on the corner edge 24, which overlaps the edge corner and exhibits outwardly a enlarged radios of curvature.

Figure 5:
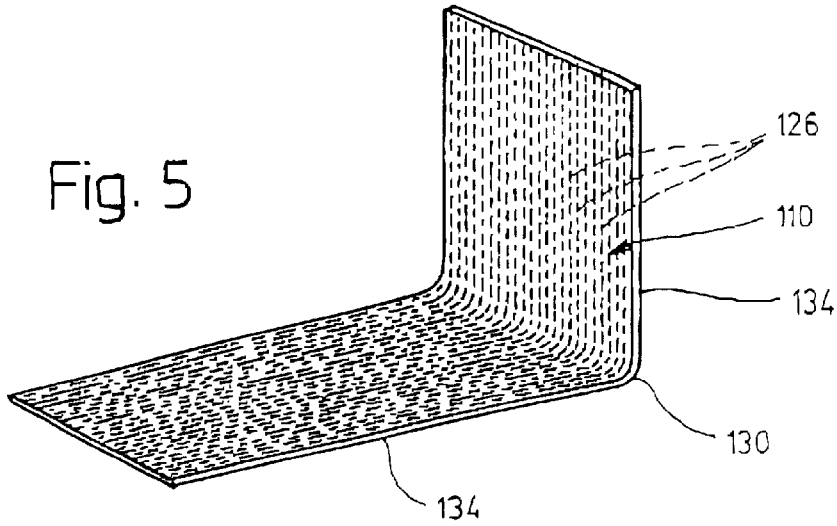
FIG. 5 a flat strip lamella formed as corner lamella in perspective representation.

The flat strip lamella shown in FIG. 5 is designed as a preformed corner lamella 110, which is likewise intended for strengthening or reinforcement of load-bearing or load-transmitting construction components 112. The corner lamella 110 includes two lamella side pieces 134 joined in the area of a rounded off corner edge 130 running perpendicular to the longitudinal direction of the reinforcing fibers 126 and defining an angle of 90 degrees. The radius of curvature in the area of the perpendicular edge corresponds for example to 5 to 50 mm. For the manufacture of the corner lamella 110 there are various possibilities:

A first method of manufacture is comprised therein, that a longitudinally extending flat strip lamella with continuous binder matrix is, in the intermediate area forming the corner edge 130, subjected to a temperature lying above the glass transition temperature of the binder matrix (300° C. to 600° C. for epoxy resin), subjected to a binding press under formation of lamella side pieces 134 connected to each other over the corner edge 130 and defining an angle with respect to each other, and subsequently cooled to room temperature under temporary maintenance of the pressure force.

Figure 6A:
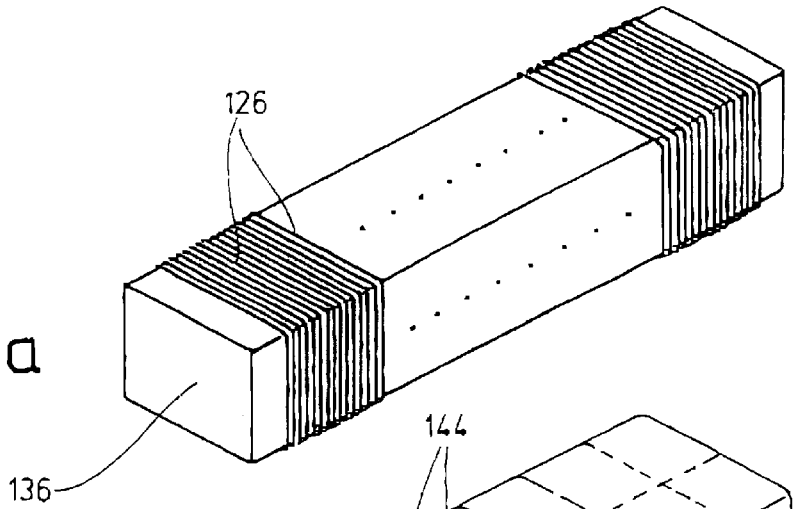
FIGS. 6*a* through *c* a schematic for explanation of a process for the production of corner lamellas according to FIG. 5.
Figure 6B:
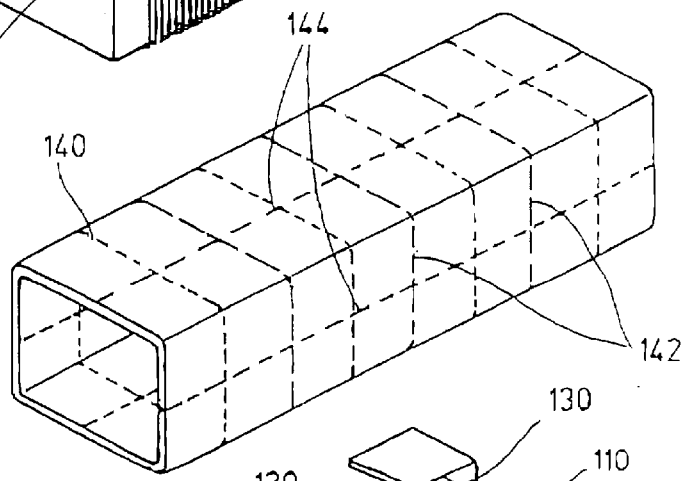
Figure 6C:
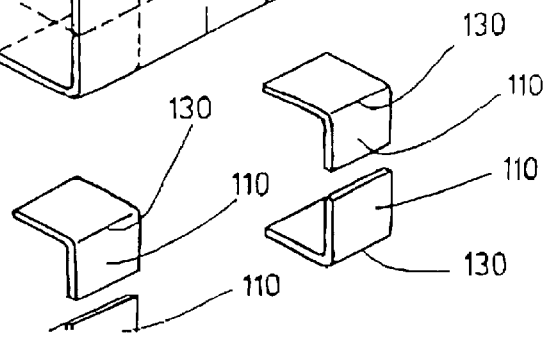

A further method of manufacture is shown FIGS. 6*a* through *c*: a cord of a plurality of parallel to each other extending carbon fibers 126 is wound about a support body 136 with square cross section and fixed in the wound state upon the support body 136 (FIG. 6*a*). Thereafter the wound fiber cord is impregnated with a fluid plastic resin to form a binder matrix. After hardening of the synthetic resin a composite material tube 140 shaped as a four-sided tube results, which can be removed from the support body 136 (FIG. 6*b*). The four-sided tube can then be separated along cut lines 142 and 144, so that corner lamellas 110 result (FIG. 6*c*), in which the reinforcing fibers 126 run in the longitudinal direction over the corner 130 as shown in FIG. 5.

As can be seen from FIGS. 7*a* through *c*, the corner lamellas 110 can be employed for reinforcing load-bearing or load transmitting construction components 112, wherein the two side pieces 134 angled with respect to each other are adhered over the corner edge 124 and to surfaces of the construction component 112 forming a corresponding angle with respect to each other by means of a not shown adhesive material layer. For extending the extension or length of reinforcement the side pieces can be adhered to each other (FIGS. 7*a* and *c*) or with the ends of the longitudinally extending flat strip lamellas 112. As can be seen from FIG. 7*c*, a closed reinforcing ring can be produced circumscribing the construction component 112.

In summary the following is to be concluded: the invention concerns a flat strip lamella for reinforcing of load-bearing or load-transmitting construction components. It is comprised of a composite structure of a plurality of parallel-to-each-other extending flexible or loose-flex reinforcing fibers 26, a binder matrix 28 which connects the reinforcing fibers with each other in a shear-resistant manner, and which can be secured on its broad side to the outer surface of the construction component 12 to be reinforced by means of an adhesive 16. In order that the flat strip lamella, which is stiff-elastic due to the binder matrix, can also be bent over a corner edge of a construction component 12, it is proposed in accordance with the invention, that the binder matrix 28 is removed from at least an intermediate area 30 with exposure of reinforcing fibers 26 and that the exposed reinforcing fibers are acted upon by a fluid or pasty hardenable synthetic resin for stabilizing the exposed reinforcing fibers in the bowed or bent condition.

What is claimed is:

1. A flat strip lamella for reinforcing load-bearing or load-transmitting construction components, the lamella comprising a plurality of flexible reinforcing fibers oriented parallel to each other; and a binder matrix which combines the reinforcing fibers in a shear-resistant manner, wherein the lamella comprises a broad side and a narrow side, wherein the lamella is secured on its broad side to an outer surface of a reinforcing construction component by using an adhesive; and wherein the lamella is:

a preformed angular lamella including a first lamella side section and a second lamella side section;

wherein both side sections meet to form an angle of from 30° to 150° degrees; and wherein the corner edge (130) has a radius of curvature of between 5 and 50 mm.

2. A flat strip lamella according to claim 1, wherein the lamella side sections form an angle of 90° to each other.

3. A method for the pre-manufacture of a bent flat strip lamella for reinforcing load-bearing or load-transmitting construction components, and wherein the flat strip lamella comprises a composite structure of a plurality of parallel-aligned flexible reinforcing fibers and a binder matrix which combines the reinforcing fibers in a shear-resistant manner, and wherein the lamella comprises a broad side and a narrow side, wherein the lamella is secured on its broad side to an outer surface of a reinforcing construction component by using an adhesive, the method comprises the steps of:

a) heating the flat strip lamella with the binder matrix in an intermediate area to be applied over the corner of the construction component, wherein the lamella is heated to a temperature above the glass transition point of the binder matrix;

b) bending the lamella during the heating step to form two lamella side sections joined at a corner and forming an angle with respect to each other; and c) cooling the bent flat strip lamella to a lower temperature under temporary maintenance of the pressure force.

4. A method for the manufacture of a bent flat strip lamella for reinforcing load-bearing or load-transmitting construction components, and wherein the flat strip lamella comprises a composite structure of a plurality of parallel-aligned flexible reinforcing fibers and a binder matrix which combines the reinforcing fibers in a shear-resistant manner, and wherein the lamella comprises a broad side and a narrow side, wherein the lamella is secured on its broad side to an outer surface of a reinforcing construction component by using an adhesive, the method comprises the steps of:

a) wrapping a fiber cord comprised of reinforcing fibers in a spiral manner about a support body with quadrilateral circumference and fixing the fiber cord thereto in the wound state;

b) impregnating the wound fiber cord with a fluid plastic resin forming a binder matrix;

c) hardening the plastic resin to form a composite material tube shaped as a four-corner tube;

d) optionally removing the support body; and e) separating the composite material tube crosswise and longitudinally multiple times to form individual corner lamellas with reinforcing fibers running over the corner edge in the longitudinal extending direction.

5. A method for the manufacture of a bent flat strip lamella for reinforcing load-bearing or load-transmitting construction components, and wherein the flat strip lamella comprises a composite structure of a plurality of parallel-aligned flexible reinforcing fibers and a binder matrix which combines the reinforcing fibers in a shear-resistant manner, and wherein the lamella comprises a broad side and a narrow side, wherein the lamella is secured on its broad side to an outer surface of a reinforcing construction component by using an adhesive, the method comprises the steps of:

a) introducing a cord or web of reinforcing fibers crosswise into a casting mold with a cavity having a right-angled cross-section, b) injecting a fluid binder resin into the cavity for impregnation of the reinforcing fibers, c) hardening the thermoplastic binder resin, optionally under the action of pressure and heat, and d) subsequently removing the formed finished angular lamella from the casting mould.

6. A method for the pre-manufacture of a bent flat strip lamella for reinforcing load-bearing or load-transmitting construction components, and wherein the flat strip lamella comprises a composite structure of a plurality of parallel-aligned flexible reinforcing fibers and a thermoplastic binder matrix which combines the reinforcing fibers in a shear-resistant manner, and wherein the lamella comprises a broad side and a narrow side, wherein the lamella is secured on its broad side to an outer surface of a reinforcing construction component by using an adhesive, the method comprises the steps of:

a) heating the flat strip lamella with the thermoplastic matrix in an intermediate area to be applied over the corner of the construction component, wherein the lamella is heated to a temperature above the glass transition point of the binder matrix;

b) bending the lamella during the heating step to form two lamella side sections joined at a corner and forming an angle with respect to each other; and c) cooling the bent flat strip lamella to a lower temperature under temporary maintenance of the pressure force.

7. A steel reinforced concrete construction component further reinforced by a flat strip lamella which is comprised of a composite structure of a plurality of flexible reinforcing fibers oriented parallel to each other and a binder matrix which combines the reinforcing fibers with each other in a shear-resistant manner;

wherein said lamella is a preformed corner lamella, which comprises two lamella side sections;

wherein the two side sections meet to forming an angle and wherein the two sections are adhered with an adhesive layer to two surfaces of the building component which forms a corresponding angle; and wherein the corner edge has a radius of curvature of between 5 and 50 mm.

8. A method according to claim 4, wherein the composite material tube is removed from the support body before being separated.

9. A method according to claim 5, wherein the binder resin is hardened or set at 100° C. to 200° C.

10. A method according to claim 5, wherein the binder resin is epoxy resin.

* * * * *